United States Patent [19]

Reid et al.

[11] Patent Number: 4,904,350

[45] Date of Patent: Feb. 27, 1990

[54] SUBMERSIBLE CONTACT CELL-ELECTROPLATING FILMS

[75] Inventors: Jonathan D. Reid, Johnson City; Eugene P. Skarvinko, Binghamton, both of N.Y.; Arthur G. Starks, New Milford, Pa.

[73] Assignee: International Business Machines Corporation, Armonk, N.Y.

[21] Appl. No.: 270,852

[22] Filed: Nov. 14, 1988

[51] Int. Cl.[4] ..... C25D 7/06; C25D 17/00

[52] U.S. Cl. ..... 204/28; 204/206; 204/279; 204/224 R

[58] Field of Search ..... 204/206, 279, 224 M, 204/28, 224 R

[56] References Cited

U.S. PATENT DOCUMENTS

| | | | |
|---|---|---|---|
| 1,515,092 | 11/1924 | Cowper-Coles | 204/206 X |
| 1,991,838 | 2/1935 | Billiter | 204/206 |
| 2,490,055 | 12/1949 | Hoff | 204/206 |
| 2,708,181 | 5/1955 | Holmes et al. | 204/28 |
| 2,974,097 | 3/1961 | Ramirez et al. | 204/224 R X |
| 3,296,114 | 1/1967 | Lloyd | 204/206 |
| 3,399,130 | 8/1968 | Lovekin | 204/206 |
| 3,579,430 | 5/1971 | Lawler | 204/206 |
| 3,865,701 | 2/1975 | Borgmann | 204/28 |
| 4,304,653 | 12/1981 | Winand | 204/206 |
| 4,305,804 | 12/1981 | Tipton | 204/213 |
| 4,422,918 | 12/1983 | Inoue | 204/206 |
| 4,662,997 | 5/1987 | Hirt et al. | 204/28 |
| 4,721,554 | 1/1988 | Sauter | 204/206 |

*Primary Examiner*—Donald R. Valentine

[57] ABSTRACT

According to the present invention, a submersible electrical current supply device and method of plating using said device for providing electrical current to a strip as it is continuously moved through an electroplating bath is provided. The electrical current supply device includes a housing having a slot extending therethrough with entry and exit openings and has wipers disposed at both the entrance and exit openings. In the central section of the device, electrical contacts in the form of electrical brushes are biased into contact with the strip and are provided with electrical contacts to supply current for plating to the brushes. The strip is continuously passed through the slot and contact with the brushes and electrical current is supplied by the brushes. The thickness of the slot and the length of the slot is so controlled as to provide an amount of electrical plating solution around the brushes which as a sufficiently high electrical resistance to substantially eliminate any electroplating of the material on to the brushes.

5 Claims, 2 Drawing Sheets

SUBMERSIBLE CONTACT CELL-ELECTROPLATING FILMS

BACKGROUND OF THE INVENTION

This invention relates generally to electroplating devices and techniques, and more particularly to devices and techniques for electroplating continuously from a solution on to a thin film of material.

In the art of electroplating, a metal is electroplated from a solution on to a work piece, the solution having an electrolyte and there being an anode provided within the solution to furnish the current.

Normally the electrical current for the cathode is applied to the work piece using a contact outside the solution. This is done in order to prevent the contact itself from becoming a work piece and causing a buildup of the plating material on the contact. In the case of relatively thick work pieces wherein the overall electrical resistance of the work piece is low, there is not a great problem involved in getting sufficient current to the work piece as it passes through the solution even at significant distances from the contact. However in the case of thin work pieces such as plating on thin film of material, and wherein the volume of the material on the work piece is small, there is a problem of rapidly diminishing current as distance from the contact increases. Expressed another way where the metal itself is thin enough or small enough to have a relatively high resistance there is rather inefficient plating accomplished at any appreciable distance from the cathode where the current is introduced.

Various plating devices and schemes are shown in the following U.S. Pat. Nos: 4, 721, 554; 4, 662, 997; 4 ; 3, 865, 701; 4, 305, 80; 4, 304, 653; 3, 579, 430; 2, 708, 181; and 2, 490, 055.

SUMMARY OF THE INVENTION

According to the present invention, a method and apparatus for improving the efficiency of electroplating on a strip of material moving through a plating bath is provided. This involves the provision of at least one electrical current supply device disposed in the bath. The device has a slot extending therethrough with entrance and exit openings for the strip of material. Electrical contact means are provided in the electrical current supply device positioned to contact the surface of the strip of material as it passes through the current supply device. The strip of material which has a film of conductive material plated thereon is passed through the slot in contact with the contact means, and current is supplied to the contact means. The slot in the supply device is so constructed to be small enough to limit the amount of plating bath which will enter the slot and surround the contact means to a very low volume. This will create a high resistance in the solution, thus resulting in a low current around the contact means, which in turn will prevent any substantial plating of the metal onto the contact. This will provide current to the strip of material for appreciable distances on both sides of the contact device to thereby enhance the plating capability of the bath onto the strip, but prevent plating on the contact means.

DESCRIPTION OF THE PREFERRED EMBODIMENT

Figure 1:
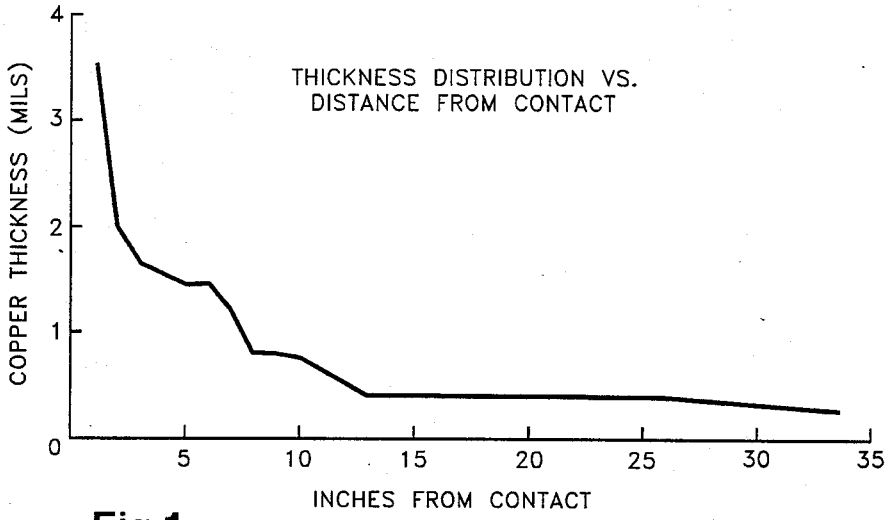
FIG. 1 is a graph showing the thickness distribution of plated copper verses the position with respect to the current applying device applying current to a 3,000 angstrom thick copper layer on a flexible substrate.

As indicated above, in the process of electroplating from an electrolyte onto a thin film of material, the current efficiency deteriorates extremely rapidly as the distance from the current supply device increases. FIG. 1 demonstrates how this rapid decrease in current affects the plating thickness at distances from the contact. In this graph, a stationary non-moving strip of flexible material having 3,000 angstroms of sputtered copper thereon was immersed in a copper plating solution and current applied to the film. The applied current was 6 amps and applied to 0.35 square feet of the film. After a given period of time, the thickness of copper plated at various distances from the location of the application of the current to the film was measured. As can be seen from the graph, the thickness of copper was about 3 ½ mils at 1 inch from the contact. At 5 inches the thickness had decreased to about 1 ½ mils and by the time the distance of 10 inches had been reached it was less than 1 mil, then dropping to less than ½ mil at the distance of 15 inches or more.

While this is a worst case scenario, nevertheless, this demonstrates very clearly a very rapid fall off in current density and hence plating efficiency as the distance from the electrode increases especially at the beginning of the plating process. Hence, in any continuous process, there is effective plating taking place only very close to the location of the application of the cathode electrical input. For this reason, it has been the practice in thin film plating to have a series of cells through which the thin film material is continuously passed and a current is applied outside at both the exit and entrance ends of each of the cells. As explained above, it has not been practical heretofore to apply current within the solution since the current applying device or devices supplying the current itself will act as a work piece and cause the solution to plate out thereon.

It has been found, however, that with the apparatus and method of the present invention, current applying devices can be submerged within the solution and current applied at various locations along the path of the material traveling in the solution without any appreciable build-up occurring where the current is applied and without the necessity of taking the strip into and out of the solution at each of the cells.

Figure 2:
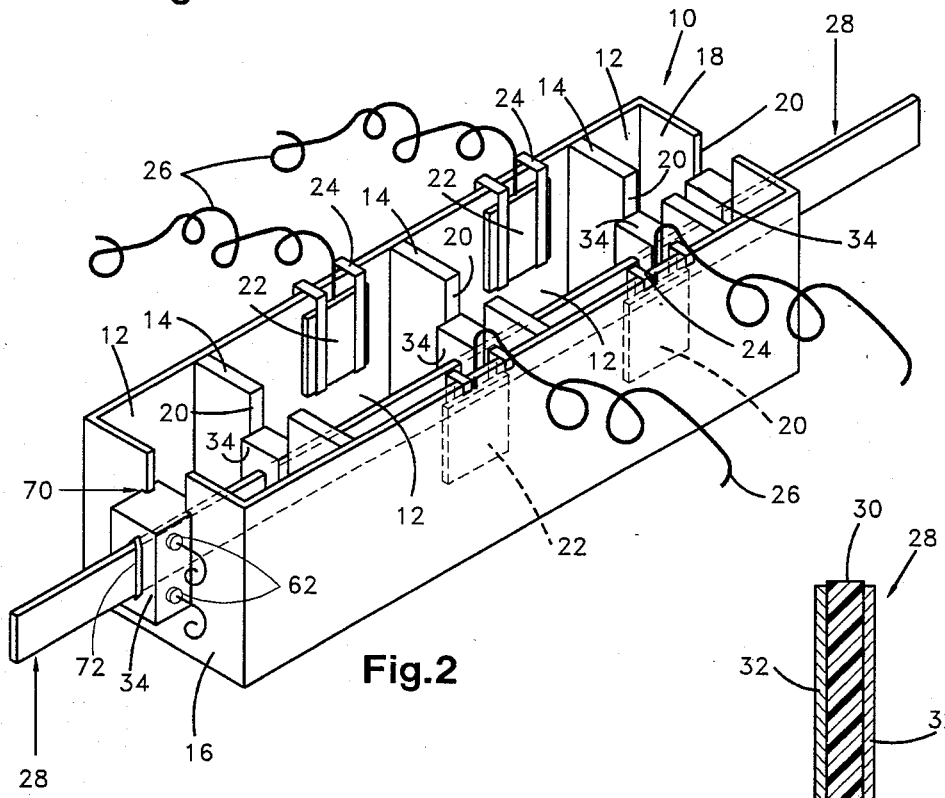
FIG. 2 is a perspective view somewhat diagrammatic of a plating bath incorporating the electrical current supply devices of this invention.

FIG. 2 shows somewhat diagrammatically a plating tank 10 which incorporates the electrical current supplying devices of this invention. The plating tank 10 is divided into a plurality of cells 12 by partitions 14. The partitions 14 as well as end walls 16 and 18 of the tank are provided with openings 20 for the reception of electrical contacting devices of this invention. Anodes 22 are mounted in each of the cells 12 by brackets 24 and current is supplied through connections 26 in a conventional way. Any conventional plating solution with appropriate anodes may be employed in the cells 12. In this instance, the invention will be described generally with respect to the plating of copper onto a thin strip of material but it is to be understood that the invention is not so limited and is applicable to any type of continuous plating onto a moving strip of material. The plating solution may be $2MH_2SO_4$ plus 0.2 M $CuSO_4$ with 50 ppm of HCl. The anodes 22 are copper.

Figure 3:
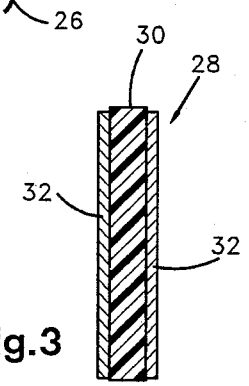
FIG. 3 is a sectional view through a strip of material to be plated.

As best shown in FIG. 3 a strip of material 28 is provided which may be a web of a flexible substrate 30 such as polyamide having a thin layer of copper 32 sputtered thereon. Conventionally of this will be copper sputtered to a thickness of several thousand angstroms and will serve as the base on which additional copper will be plated.

Figure 5:
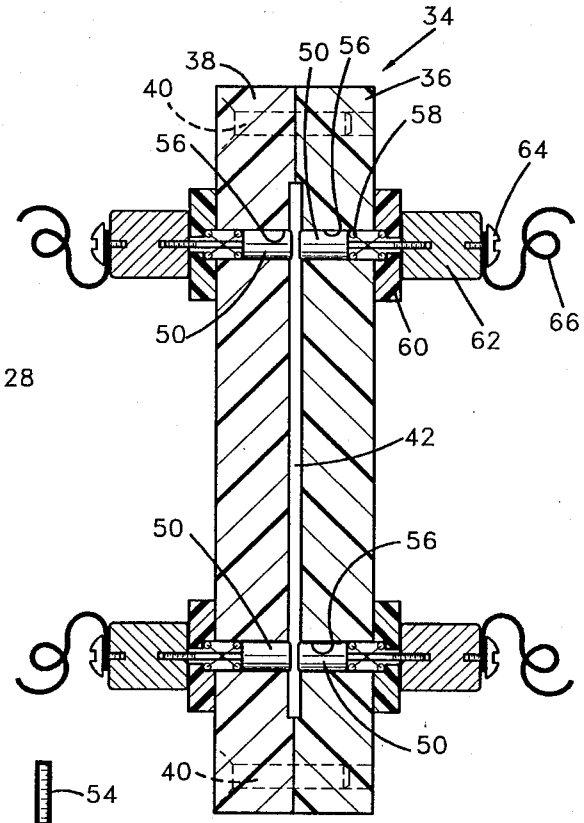
FIG. 5 is a sectional view taken substantially along the plane of line 5—5 of FIG. 3.
Figure 6:
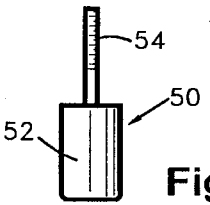
FIG. 6 is a detail view of a copper brush utilized in the current supply device.
Figure 4:
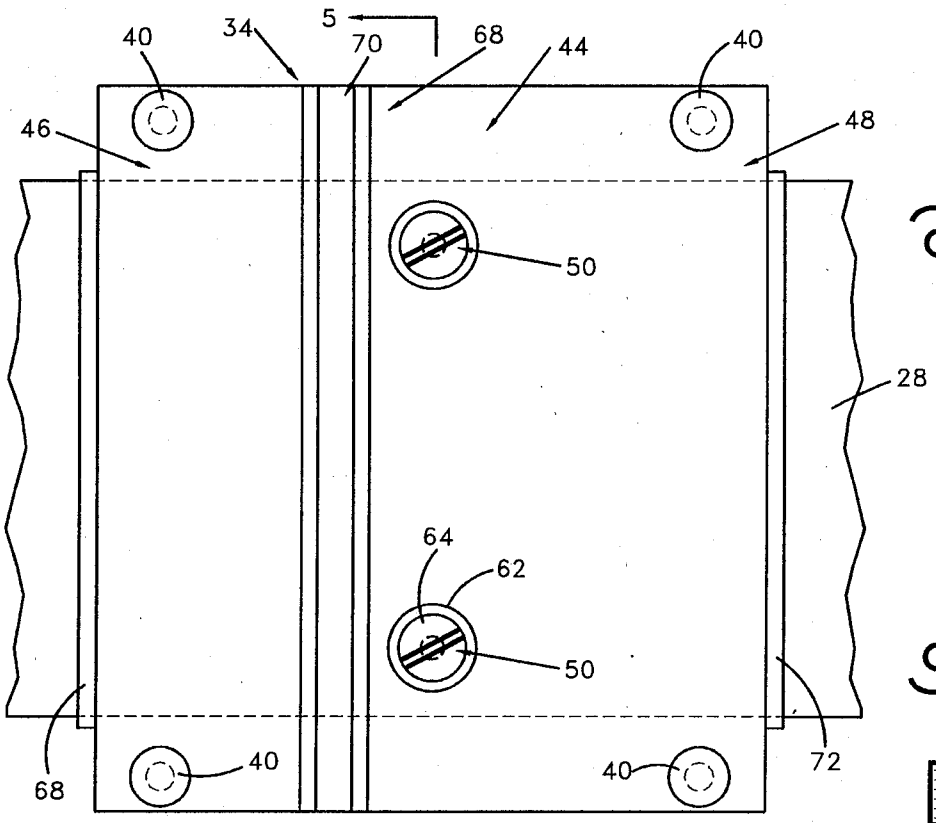
FIG. 4 is a side elevational view of a electrical current supplying device according to this invention.

An electrical contacting device 34 is disposed in each of the openings 20. As can best be seen in FIGS. 4 and 5, each of the electrical contacting devices 34 includes a body portion made of an inert material such as a molded polycarbonate plastic. The body may be formed in any conventional manner. One particularly desirable way is forming the body out of two mating halves 36 and 38 which are secured together by fasteners 40. A slot 42 extends the length of the body of the contacting device 34 and is slightly wider than the width of the strip to be plated. The electrical contact device 34 is divided into three sections, a central section 44, an entry section 46 and an exit section 48. Disposed in the central section 44 are electrical brushes 50 constructed as shown in FIG. 6. The brushes 50 each include a contact end 52 with a threaded stem 54. The brushes 50 are disposed in openings 56 formed in the central section 44. The brushes are biased by coil springs 58 which are captivated between a washer 60, bonded to the body halves 36 and 38, and the contact end 52 of the brush. A knurled thumb nut 62 is threaded on to the threaded stem 54 and by adjustment of the nut the location of the brush within the slot can be adjusted. Each of the brushes has a screw 64 screwed onto the end of the threaded stem 54 which provides an electrical connection to connector 66 to the brushes 54 for the cathode current. Each of the body halves 36, 38 is provided with a vertically extending channel member 68 having a slot 70 which slides into the opening 20 of the partitions 14 and end walls 16, 18. With the contacting devices 38 in the end walls 16 and 18, they may be oriented such that the washer 60 and thumb nuts 62 are outside of the tank and thus outside the solution. This is the configuration shown in FIGS. 2, 4 and 5, with the brushes of set somewhat toward the entrance end 46. However, if the entire device 34 is to be submerged, the brushes 50 can be more centrally located. In the case of those contact devices 34 which are in the partitions 14 and thus may have their washers 60 and nuts 62 as located within the solution, any suitable non-conducting cover can be utilized to cover these exposed metal parts and thus prevent plating from occurring on them.

If desired, flexible wiper strips 72 can be provided at the entry end 46 and exit end 48 of the contact devices 44 and on each side of the slot to wipe against the strip as it enters and as it leaves the device. Flow of the plating solution also cools the part at the contact.

To obtain a uniform plating thickness distribution, to avoid heating or burning of plastic substrates, and to form an acceptable deposit metallurgy on the web being plated, it is desirable to control the current applied as a function of position in the tank. This is most efficiently accomplished by increasing the amount of current applied at successive contacts and gradually increasing the distance between contacts from the beginning to the end of the tank. For example, the initial contact may deliver a current of 3 amps and be separated from the second contact by a distance of 1 ft., while the last contact may deliver a current of 50 amps and be separated from the previous contact by a distance of 4 ft. (However, for convenience of illustration, these ratios are not shown in FIG. 2). Each contact is always connected to a separate power supply.

For the reasons listed above, it is also most efficient to increase the current density at the surface of the web from the beginning of the end of the line. For example, a current density of 15 A/sq. ft. may be applied to the surface of the web in the first few feet of the tank, while a current of 40 A/sq. ft. may be applied in the last few feet of tank.

One of the important features of the present invention is controlling the thickness of the slot 42. The slot 42 must be thick enough to allow the entry and exit of the strip including the material plated thereon but it should be sufficiently thin so as to restrict the entry of the electrolyte into the slot at the area of the brushes. It has been found that a thickness of about 0.05 inches is preferred for this thickness. It is also necessary that there be a significant distance between the brushes 50 and the entry and exit openings 46 and 48. The reason that these dimensions are important is as follows:

It is necessary to limit the amount of current flowing through the electrolyte at the brushes to as small a value as possible to prevent plating from the solution on to the brushes rather than on to the work piece. By maintaining the thickness of the slot at a minimum and a relatively long distance between the entrance and exit ends of the slots and the electrical brushes, it is possible to raise the electrical resistance of the solution to such an extent that very little current density is available at the brushes to cause plating of the metal from the solution. Of course, it can be appreciated that it is not necessary to exclude all of the electrolyte from the slot and from the region around the brushes. It is merely necessary to significantly raise the resistance of the solution in this region so as to reduce to a minimum amount any plating that might tend to take place on the contacts. This is done by limiting the actual cross-sectional area and increasing the length of the current path necessary to travel through the solution to get to the brushes.

The slot 42 also acts as a guide and support for the flexible material 20 as it passes through the various cells 12 during plating.

It will also be appreciated that the number of cells 12 in any given tank and for any given plating operation can be varied depending upon the thickness of the final plating layer desired, the thickness of the metal layer, etc. Also the length of any cell is determined by how far on either side of the particular current applying device an effective plating current is carried. These factors can all be determined and the application selected by routine experimentation.

While the invention has been described in some degree of particularity various adaptations and modifications can be made without departing from the scope of the invention as defined in the appended claims.

What is claimed is:

1. A submersible electrical current supply device for use in electroplating a material on to a thin film which is continuously moved through an electroplating solution comprising:

a housing assembly having a slot extending therethrough of sufficient size to receive and guide the film that is to be electroplated, said housing assembly having a central section, an entry section and an exit section, electrical contact means disposed in said central section positioned to contact at least one side of said film of material as it passes through said slot;

means to supply electrical power to said electrical contact means;

said slot being of sufficiently small thickness and sufficiently long length to allow access of the solution therein but to provide high enough electrical resistance in the solution contained in the slot to prevent any significant plating of material at the contacts.

2. The device as defined in claim 1 wherein said electrical contact means are brush means.

3. The device as defined in claim 2 wherein said brush means are spring biased into contact with said strip.

4. The device as defined in claim 1 further characterized by flexible wiper means disposed at the entry and exit openings of said slot.

5. A method of improving the efficiency of electroplating onto a strip of material from plating bath of plating solution comprising the steps of:

providing at least one electrical current supply device disposed in said bath, said device having a slot extending therethrough with exit and entrance openings therein;

providing electrical contact means within said current supply deice, passing said strip through said slot in contact with the contact means, supplying current to contact means, and providing plating solution in said slot but limiting the amount of plating solution surround said contact device so as to provide electrical resistance in the solution sufficiently high to prevent any appreciable plating occurring on said contact.

* * * * *